US010885830B2

(12) United States Patent
Tseng et al.

(10) Patent No.: US 10,885,830 B2
(45) Date of Patent: Jan. 5, 2021

(54) ELECTRONIC DEVICE CAPABLE OF REDUCING COLOR SHIFT

(71) Applicant: InnoLux Corporation, Miao-Li County (TW)

(72) Inventors: Ming-Chun Tseng, Miao-Li County (TW); Chin-Lung Ting, Miao-Li County (TW); Kung-Chen Kuo, Miao-Li County (TW); Ker-Yih Kao, Miao-Li County (TW); Chung-Kuang Wei, Miao-Li County (TW); Chih-Yung Hsieh, Miao-Li County (TW); Li-Wei Mao, Miao-Li County (TW); Ho-Tien Chen, Miao-Li County (TW); Cheng-Fu Wen, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/449,451

(22) Filed: Jun. 24, 2019

(65) Prior Publication Data

US 2020/0035145 A1 Jan. 30, 2020

Related U.S. Application Data

(60) Provisional application No. 62/733,593, filed on Sep. 19, 2018, provisional application No. 62/702,355, filed on Jul. 24, 2018.

(30) Foreign Application Priority Data

Jan. 3, 2019 (CN) ..... 2019 1 0005691
May 9, 2019 (CN) ..... 2019 1 0385594

(51) Int. Cl.
*G09G 3/22* (2006.01)
*G09G 3/20* (2006.01)
(Continued)

(52) U.S. Cl.
CPC ..... *G09G 3/22* (2013.01); *G09G 3/2011* (2013.01); *G09G 3/2014* (2013.01);
(Continued)

(58) Field of Classification Search
CPC ..... H05B 45/37; H05B 45/10; H05B 45/44; H05B 45/46; H05B 47/10; H05B 33/08;
(Continued)

(56) References Cited

U.S. PATENT DOCUMENTS 6,646,654 B2 * 11/2003 Takagi ..... G09G 3/3283 345/690
7,498,754 B2 * 3/2009 Masood ..... H05B 45/37 315/291

(Continued)

OTHER PUBLICATIONS

Mohammad Torikul Islam Badal et al., Design of a Low-power CMOS Level Shifter for Low-delay SoCs in Silterra 0.13 μm CMOS Process, Journal of Engineering Science and Technology Review, Sep. 14, 2017, pp. 10-15, XP055668431.

*Primary Examiner* — Dismery Mercedes
(74) *Attorney, Agent, or Firm* — Winston Hsu

(57) ABSTRACT

An electronic device includes a substrate and a plurality of light-emitting driving circuits. The plurality of light-emitting driving circuits are disposed on the substrate. Each of the plurality of light-emitting driving circuits includes a switch component and a pulse modulation unit. The switch component has a first terminal and a second terminal. The first terminal of the switch component is coupled to a comparison signal line. The pulse modulation unit has a first terminal and a second terminal. The first terminal of the pulse modulation unit is coupled to a data line, and the second terminal of the pulse modulation unit is coupled to the second terminal of the switch component.

19 Claims, 9 Drawing Sheets

(51) Int. Cl.
*G09G 3/32* (2016.01)
*G09G 3/34* (2006.01)

(52) U.S. Cl.
CPC ..... *G09G 3/2081* (2013.01); *G09G 3/32* (2013.01); *G09G 3/3406* (2013.01); *G09G 2300/08* (2013.01); *G09G 2310/0202* (2013.01); *G09G 2310/0254* (2013.01); *G09G 2310/0289* (2013.01); *G09G 2310/06* (2013.01); *G09G 2310/08* (2013.01); *G09G 2320/0242* (2013.01); *G09G 2320/064* (2013.01); *G09G 2320/0633* (2013.01); *G09G 2320/0646* (2013.01)

(58) Field of Classification Search
CPC .... G09G 3/342; G09G 3/3208; G09G 3/3216; G09G 3/3225; G09G 3/32; G09G 2320/064; G09G 2320/0633; G09G 2320/0646; G09G 2320/0626; G09G 2320/0242; G09G 2320/043; G09G 2320/045; G09G 2320/0233; G09G 2310/08; G09G 2310/06; G09G 3/3233; G09G 3/2011; G09G 3/2018; G09G 3/2081; G09G 3/3406; G09G 3/22; G09G 3/3258; G09G 3/2014; G09G 2300/08
See application file for complete search history.

(56) References Cited

U.S. PATENT DOCUMENTS

| | | | | |
|---|---|---|---|---|
| 9,072,128 | B2 * | 6/2015 | Su | H05B 45/20 |
| 9,235,109 | B2 * | 1/2016 | Yamamuro | G03B 21/2033 |
| 9,514,689 | B2 * | 12/2016 | Lee | G09G 3/3426 |
| 10,455,653 | B1 * | 10/2019 | Watanabe | G09G 3/32 |
| 10,706,766 | B2 * | 7/2020 | Kim | G09G 3/2011 |
| 2002/0012008 | A1 * | 1/2002 | Takagi | G09G 3/3283 345/691 |
| 2002/0047817 | A1 | 4/2002 | Tam | |
| 2005/0057455 | A1 * | 3/2005 | Peng | G09G 3/3208 345/76 |
| 2006/0176256 | A1 | 8/2006 | Yen | |
| 2011/0037748 | A1 * | 2/2011 | Kang | G09G 3/3648 345/211 |
| 2011/0199011 | A1 * | 8/2011 | Nakazawa | G09G 3/342 315/193 |
| 2013/0082906 | A1 | 4/2013 | Toyomura | |
| 2013/0335394 | A1 * | 12/2013 | Sun | G09G 3/3233 345/212 |
| 2014/0218272 | A1 | 8/2014 | Kikuchi | |
| 2016/0351130 | A1 * | 12/2016 | Kikuchi | H03M 1/18 |
| 2017/0206832 | A1 | 7/2017 | Lee | |
| 2018/0197471 | A1 * | 7/2018 | Rotzoll | G09G 3/2003 |
| 2018/0247586 | A1 * | 8/2018 | Vahid Far | G09G 3/3216 |
| 2019/0371232 | A1 * | 12/2019 | Kim | G09G 3/3225 |
| 2020/0126473 | A1 * | 4/2020 | Chibashi | G09G 3/32 |

* cited by examiner

ELECTRONIC DEVICE CAPABLE OF REDUCING COLOR SHIFT

CROSS REFERENCE TO RELATED APPLICATION

This non-provisional application claims priority of US patent application No. 62/702,355, filed on 24 Jul. 2018, China patent application No. 201910005691.7, filed on 3 Jan. 2019, China patent application No. 201910385594.5, filed on 9 May 2019, and US patent application No. 62/733,593, filed on 19 Sep. 2018, included herein by reference in its entirety.

BACKGROUND OF THE DISCLOSURE

1. Field of the Disclosure

The disclosure relates to an electronic device, and specifically, to an electronic device capable of reducing color shift.

2. Description of the Prior Art

Presently, passive matrix (PM) and active matrix (AM) driving methods have been adopted as two primary methods for driving light-emitting components. Despite the complicated process for fabricating an active matrix, each pixel in the active matrix can be driven continuously and independently, and driving signal of each pixel can be recorded without using a high pulse current for a long time to drive each pixel, providing higher efficiency and extending a service life of a light-emitting electronic device in comparison to the passive matrix driving method.

In the conventional art, the active matrix driving method employs different magnitudes of driving currents to drive light-emitting components for the light-emitting components to produce different luminance levels. For example, in each frame cycle, a display panel continuously drives light-emitting components using a corresponding driving current, and employs an updated driving current to drive the light-emitting components in the next frame cycle to enable the light-emitting components to provide a luminance level required for each frame. In such a situation, a smaller driving current is employed to drive the light-emitting components when a luminance level to be provided by the light-emitting components is lower. Nevertheless, the light-emitting components can easily exhibit visible color shifts as the current varies, resulting in unfavorable display quality.

SUMMARY OF THE DISCLOSURE

In one aspect of the invention, an electronic device including a substrate and a plurality of light-emitting driving circuits is disclosed. The plurality of light-emitting driving circuits are disposed on the substrate. Each of the plurality of light-emitting driving circuits includes a switch component and a pulse modulation unit. The switch component has a first terminal and a second terminal. The first terminal of the switch component is coupled to a comparison signal line. The pulse modulation unit has a first terminal and a second terminal. The first terminal of the pulse modulation unit is coupled to a data line, and the second terminal of the pulse modulation unit is coupled to the second terminal of the switch component.

These and other objectives of the present disclosure will no doubt become obvious to those of ordinary skill in the art after reading the following detailed description of the embodiment that is illustrated in the various figures and drawings.

DETAILED DESCRIPTION

Figure 1:
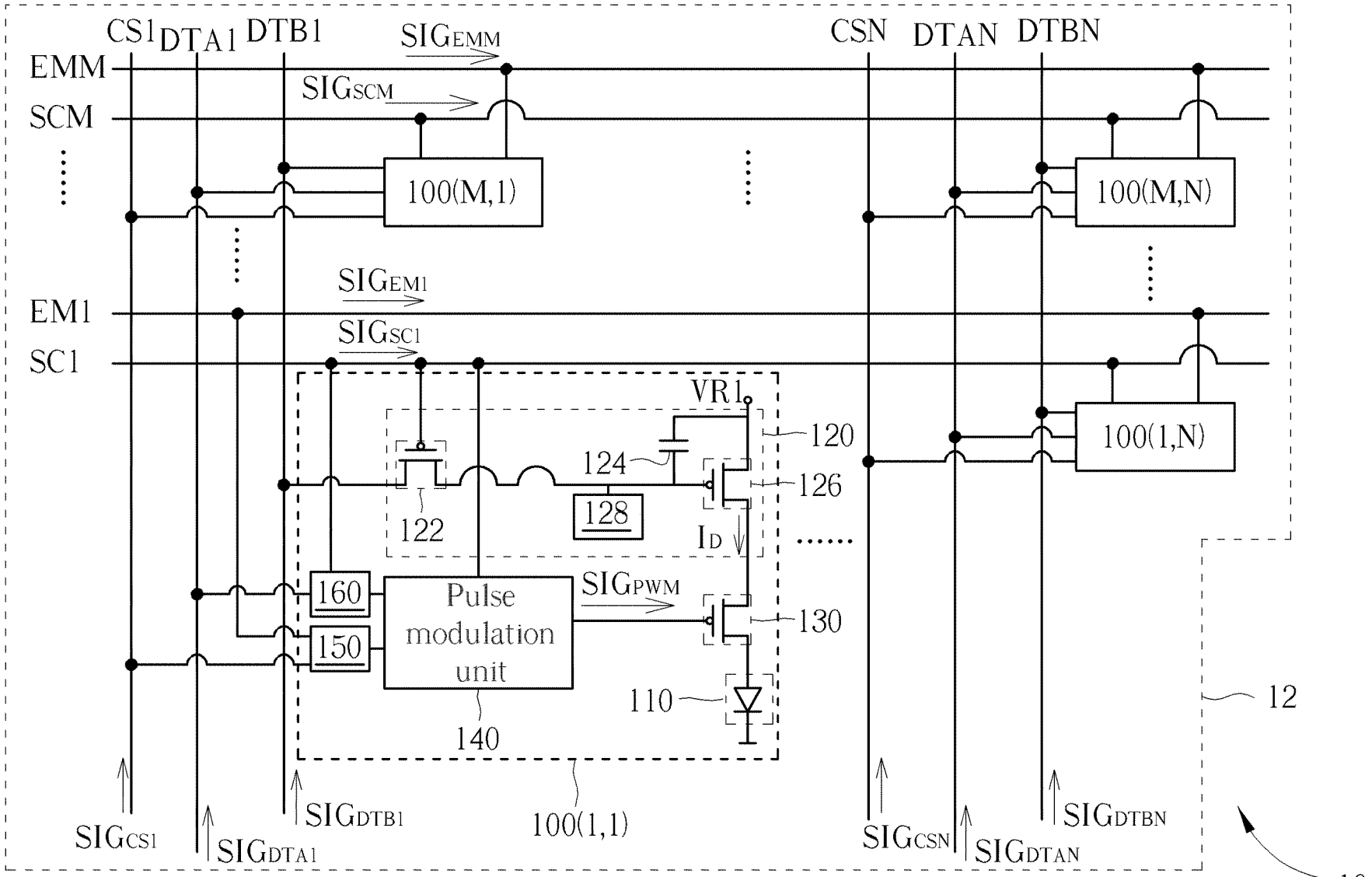
FIG. 1 is a schematic diagram of an electronic device according to an embodiment of the disclosure.

FIG. 1 is a schematic diagram of an electronic device 10 according to an embodiment of the disclosure. The electronic device 10 comprises a substrate 12 and a plurality of light-emitting driving circuits 100 (1,1) through 100 (M,N) disposed on the substrate 12 where M and N may be positive integers. The substrate 12 has a plurality of scan lines SC1 through SCM, a plurality of first data lines DTA1 through DTAN, a plurality of second data lines DTB1 through DTBN, a plurality of light emission control lines EM1 through EMM, and a plurality of comparison signal lines CS1 through CSN formed thereon.

In some embodiments of the disclosure, the plurality of light-emitting driving circuits 100(1,1) through 100(M,N) may have identical structures and may be operated according to the same principle. In FIG. 1, the light-emitting driving circuits 100(1,1) through 100 (M,N) may be arranged in a matrix, and respectively coupled to the plurality of scan lines SC1 through SCM, the plurality of first data lines DTA1 through DTAN, the plurality of second data lines DTB1 through DTBN, the plurality of light emission control lines EM1 through EMM, and the plurality of comparison signal lines CS1 through CSN.

As used herein, the term "coupling" may refer to a direct electrical connection between two components or an indirect electrical connection in which a third component is present between two components. The coupling as defined herein is applicable to all embodiments throughout the disclosure. Further, numerical orders such as a first transistor, a second transistor, a first storage device, and a second storage device merely serve to identify each component, and do not serve as a limitation to the components or an order of the components.

In another embodiment, the arrangement of the plurality of light-emitting driving circuits 100(1,1) through 100(M,N) is not limited to a matrix, and may be changed on the basis of the shape of the electronic device 10. For example, for a circular, elliptical or arbitrary shape of the electronic device 10, the plurality of light-emitting driving circuits 100(1,1) through 100(M,N) may be arranged in a matrix at a central area, and in a non-matrix shape such as a staggered arrangement at a non-central area. The non-central area may be a peripheral area of the electronic device 10. The embodiments described herein serve to be examples but not limitations.

The plurality of scan lines SC1 through SCM may respectively transmit a plurality of scan signals $SIG_{SC1}$ through $SIG_{SCM}$ to respectively receive scan data voltages at the corresponding light-emitting driving circuits 100(1,1) through 100(M,N). The plurality of second data lines DTB1 through DTBN may respectively transmit a plurality of predetermined data signals $SIG_{DTB1}$ through $SIG_{DTBN}$.

In the embodiment of the disclosure, the plurality of predetermined data signals $SIG_{DTB1}$ through $SIG_{DTBN}$ may respectively have constant voltages to drive using constant driving currents the respective light-emitting components 110 in the light-emitting driving circuits 100(1,1) through 100(M,N) to emit light. In some embodiments, the constant voltages or constant driving currents may not be invariant constants, and may vary slightly with time, e.g., the voltages or driving currents may be regarded as constant if the voltages or driving currents are within plus or minus 10 percent of the values of the predetermined data signals, and the values of the predetermined data signals may be predetermined ideal values of the voltages or driving currents. The embodiments provided herein serve to be examples but not limitations.

The plurality of first data lines DTA1 through DTAN may respectively transmit a plurality of emission data signals $SIG_{DTA1}$ through $SIG_{DTAN}$, and the plurality of comparison signal lines CS1 through CSN may respectively transmit a plurality of variation comparison signals $SIG_{CS1}$ through $SIG_{CSN}$. In the embodiment of the disclosure, the voltages of the plurality of emission data signals $SIG_{DTA1}$ through $SIG_{DTAN}$ may respectively correspond to luminance of the light-emitting components 110 in the light-emitting driving circuits 100(1,1) through 100(M,N), e.g., maximum luminance of the light-emitting components, minimum luminance of the light-emitting components or predetermined luminance of the light-emitting components. The embodiments provided herein serve to be examples but not limitations. The corresponding emission pulse durations of the light-emitting driving circuits 100(1,1) through 100(M,N) may be controlled according to a comparison result of the emission data signals $SIG_{DTA1}$ through $SIG_{DTAN}$ and the corresponding variation comparison signals $SIG_{CS1}$ through $SIG_{CSN}$. The light emission control lines EM1 through EMM may transmit light emission control signals $SIG_{EM1}$ through $SIG_{EMM}$ to control timing of light emission of the light-emitting driving circuits 100(1,1) through 100(M,N).

In some embodiments, the emission pulse duration may be a ratio of a light emission time to a unit period of the light-emitting component 110. The emission pulse duration is not limited to a value of the ratio, and users may adjust respective emission pulse durations of the light-emitting driving circuits 100(1,1) through 100(M,N) according to an overall color shift of the plurality of light-emitting components 110 in the light-emitting driving circuits 100(1,1) through 100(M,N). The embodiments described herein serve to be examples but not limitations.

In other embodiments, the light-emitting components 110 may be organic light-emitting diodes (OLED), quantum dot light-emitting diodes, mini light-emitting diodes or micro light-emitting diodes. A plurality of electronic devices 10 may be combined into a tiled electronic device, are not limited to employing a single type of light-emitting components 110, and may employ different types of light-emitting components 110. The embodiments described herein serve to be examples but not limitations.

Further, in some embodiments, the light-emitting driving circuit 100 (1,1) may comprise the light-emitting component 110, a current output unit 120, a current switch unit 130, a pulse modulation unit 140 and a switch component 150. The current output unit 120 may be coupled to the scan line SC1 and the second data line DTB1, and generate a constant driving current $I_D$ according to the scan signal $SIG_{SC1}$ and the predetermined data signal $SIG_{DTB1}$. The light-emitting component 110 may be driven by the driving current $I_D$ to emit light.

The switch component 150 has a first terminal and a second terminal. The first terminal of the switch component 150 may be coupled to the comparison signal line CS1 to receive the variation comparison signal $SIG_{CS1}$. The pulse modulation unit 140 has a first terminal and a second terminal. The first terminal of the pulse modulation unit 140 may be coupled to the first data line DTA1 to receive the emission data signal $SIG_{DTA1}$, and the second terminal of the pulse modulation unit 140 may be coupled to the second terminal of the switch component 150. In some embodiments, the light-emitting driving circuit 100(1,1) may further comprise a switch component 160, and the first terminal of the pulse modulation unit 140 may be coupled to the first data line DTA1 via the switch component 160. In FIG. 1, the switch components 150 and 160 may respectively control the pulse modulation unit 140 according to the light-emission control signal $SIG_{EM1}$ and the scan signal $SIG_{SC1}$ to receive the variation comparison signal $SIG_{CS1}$ and the emission data signal $SIG_{DTA1}$ at the appropriate time, and the pulse modulation unit 140 may compare the emission data signal $SIG_{DTA1}$ and the variation comparison signal $SIG_{CS1}$ to generate an emission duration modulation signal $SIG_{PWM}$.

The current switch unit 130 may be coupled to the pulse modulation unit 140, the current output unit 120 and the light-emitting component 110. The current switch unit 130 may receive the emission duration modulation signal $SIG_{PWM}$, and modulate the driving current $I_D$ received by the light-emitting component 110 according to the emission duration modulation signal $SIG_{PWM}$ to generate a corresponding emission pulse duration.

Figure 2:
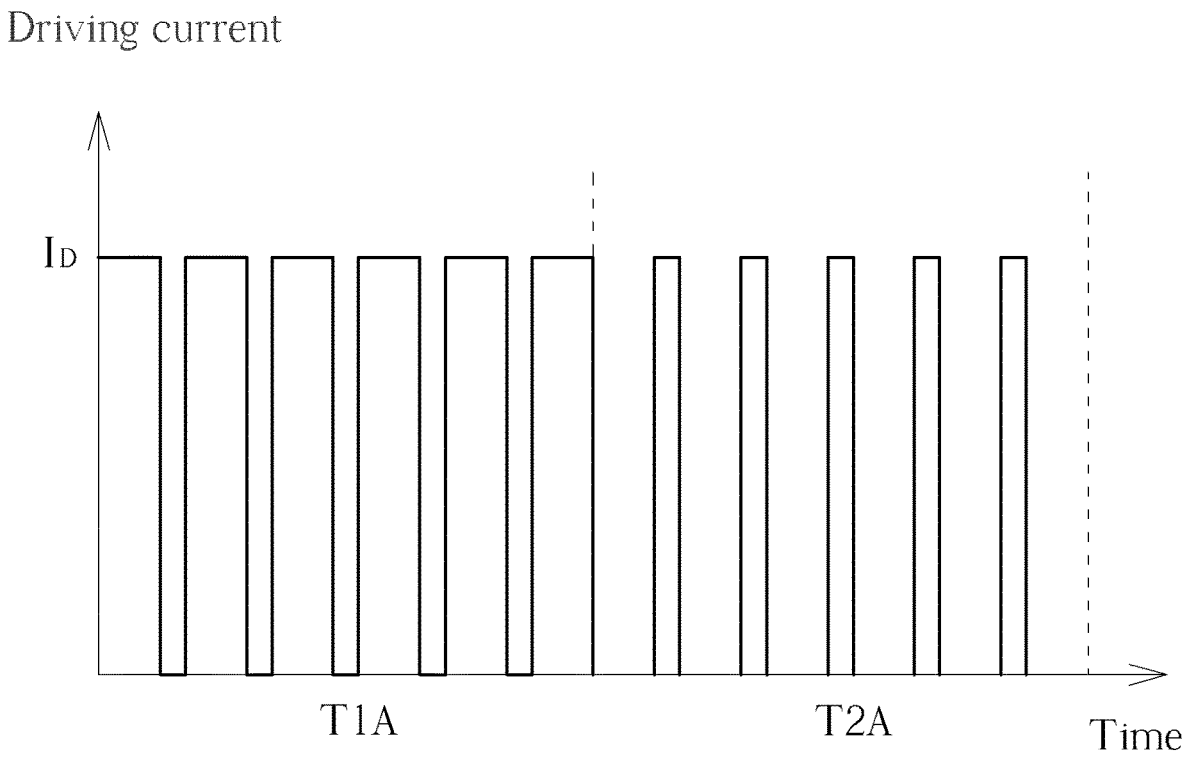
FIG. 2 is a schematic diagram illustrating a emission pulse duration of a light-emitting component driven by a driving current for various luminance produced by the light-emitting driving circuit in FIG. 1.

In the light-emitting driving circuit 100 (1,1), the current output unit 120 may generate the driving current $I_D$ according to the constant voltage of the scan signal $SIG_{SC1}$, and control the emission pulse duration of the light-emitting component 110 via the current switch unit 130. FIG. 2 is a schematic diagram illustrating a emission pulse duration of the light-emitting component 110 driven by the driving current $I_D$ for various luminance levels produced by the light-emitting driving circuit 100 (1,1). In some embodiments, the magnitude of the driving current $I_D$ may be computed according to an integral of the magnitudes of all driving currents in specific time intervals such as T1A or T2A.

In FIG. 2, the light-emitting driving circuit 100 (1,1) produces higher luminance in the time interval T1A, since the emission pulse duration of the light-emitting component 110 driven by the driving current $I_D$ is larger. In comparison, the light-emitting driving circuit 100(1,1) produces lower luminance in the time interval T2A, since the emission pulse duration of the light-emitting component 110 driven by the driving current $I_D$ is lower. Regardless of being in the time intervals T1A or T2A, the magnitude of the driving current $I_D$ remains constant. In other words, the light-emitting component 110 may be driven by an appropriate driving current $I_D$ to produce lower luminance, thereby reducing color shift resultant from employing a low driving current to drive the light-emitting component 110.

In some embodiments of the disclosure, the constant voltages of the plurality of predetermined data signals $SIG_{DTB1}$ and $SIG_{DTB2}$ may be configured according to the properties of the light-emitting component 110, i.e., the appropriate driving current $I_D$ may be generated by the current output unit 120 by selecting appropriate predetermined data signals $SIG_{DTB1}$ and $SIG_{DTB2}$, and the light-emitting component 110 may be operated without any color shift.

In FIG. 1, the current output unit 120 may comprise a sampling switch 122, a first storage device 124 and a driving component 126.

The sampling switch 122 has a first terminal, a second terminal and a control terminal. The first terminal of the sampling switch 122 is coupled to the second data line DTB1, and the control terminal of the sampling switch 122 is coupled to the scan line SC1. In FIG. 1, the sampling switch 122 may comprise a transistor. In some embodiments, a semiconductor of the transistor may comprise amorphous silicon, low temperature polysilicon, metal-oxide, or combination thereof. The embodiments provided herein merely serve to be examples but not limitations.

The first storage device 124 has a first terminal and a second terminal. The first terminal of the first storage device 124 is coupled to the second terminal of the sampling switch 122, and the second terminal of the first storage device 124 is configured to receive a first system voltage VR1. In FIG. 1, the first storage device 124 may comprise a capacitor, memory or any component capable of storing electrical charges or voltages. The embodiments provided herein merely serve to be examples but not limitations.

The driving component 126 has a first terminal, a second terminal and a control terminal. The first terminal of the driving component 126 is coupled to the second terminal of the first storage device 124, the second terminal of the driving component 126 is configured to output the driving current $I_D$, and the control terminal of the driving component 126 is coupled to the second terminal of the sampling switch 122. In FIG. 1, the driving component 126 may comprise a transistor.

In such a situation, when the light-emitting driving circuit 100(1,1) performs a scan, the sampling switch 122 is turned on by the scan signal $SIG_{SC1}$ to enable the first storage device 124 to receive the predetermined data signal $SIG_{DTB1}$ from the second data line DTB1, and generate a corresponding bias voltage between the first terminal and the control terminal of the driving component 126, thereby enabling the driving component 126 to generate a corresponding magnitude of driving current $I_D$.

Further, owing to variations in the fabricating process being uncontrollable, the driving components 126 may generate different driving currents according to identical bias voltages in different light-emitting driving circuits 100 (1,1) through 100 (M,N). In FIG. 1, the current output unit 120 may further comprise a threshold voltage compensation component 128 coupled to the control terminal of the driving component 126. The threshold voltage compensation component 128 may compensate threshold voltages of the driving components 126 to enable the driving components 126 in different light-emitting driving circuits 100 (1,1) through 100 (M,N) to generate substantially identical driving currents according identical bias voltages.

Figure 3:
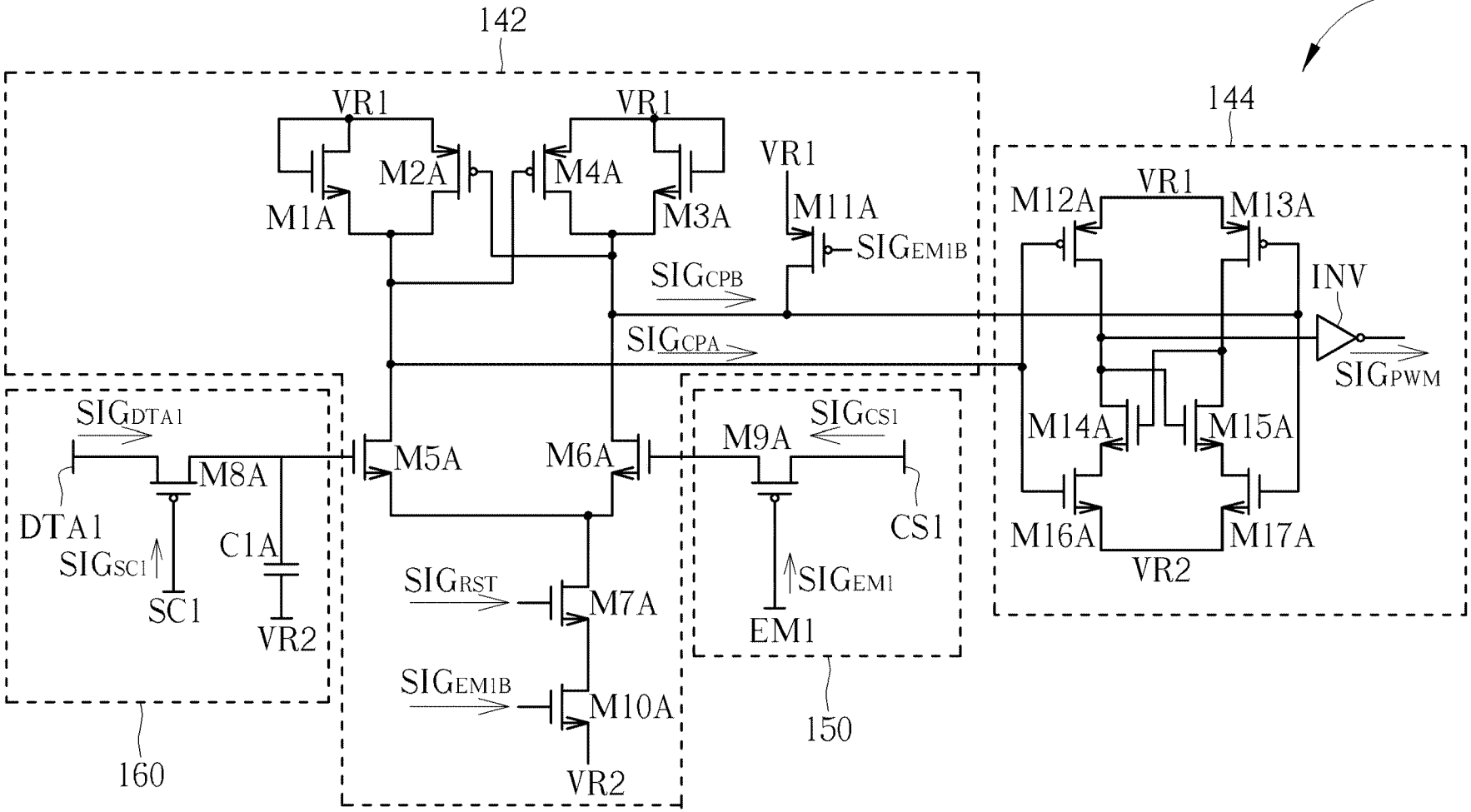
FIG. 3 is a schematic diagram of the pulse modulation unit in FIG. 1.

FIG. 3 is a schematic diagram of the pulse modulation unit 140 in the light-emitting driving circuit 100(1,1) according to another embodiment of the disclosure. The pulse modulation unit 140 may comprise a comparator 142 and a voltage shifter circuit 144.

The comparator 142 comprises a first input terminal, a second input terminal, a first output terminal and a second output terminal. The first input terminal of the comparator 142 is coupled to the first terminal of the pulse modulation unit 140 to receive the emission data signal $SIG_{DTA1}$ via the second switch component 160, the second input terminal of the comparator 142 is coupled to the second terminal of the pulse modulation unit 140 to receive the variation comparison signal $SIG_{CS1}$ via the first switch component 150. The comparator 142 may be configured to compare the emission data signal $SIG_{DTA1}$ and the variation comparison signal $SIG_{CS1}$ to respectively output, via the first output terminal and the second output terminal of the comparator 142, a first comparison signal $SIG_{CPA}$ and a second comparison signal $SIG_{CPB}$, and the first comparison signal $SIG_{CPA}$ and second comparison signal $SIG_{CPB}$ are opposite in polarity. The voltage shifter circuit 144 is coupled to the first output terminal and the second output terminal of the comparator 142, and configured to shift voltage levels of the first comparison signal $SIG_{CPA}$ and the second comparison signal $SIG_{CPB}$ to generate the emission duration modulation signal $SIG_{PWM}$.

In some embodiments, the voltage shifter circuit 144 may shape or adjust outputs from the first output terminal and the second output terminal of the comparator 142, e.g., if waveforms at the first output terminal and the second output terminal of the comparator 142 are close to square-wave signals, there might be ripples present at the rising edge or falling edge of the square-wave signals, and the voltage shifter circuit 144 may shape the square-wave signals into ideal square-wave signals, i.e., the ripples at the rising edge or falling edge of the square-wave signals may be reduced. The embodiments provided herein serve to be examples but not limitations.

The comparator 142 may comprise a first transistor MIA through a seventh transistor M7A. The first transistor MIA has a first terminal, a second terminal and a control terminal. The first terminal of the first transistor MIA may receive the first system voltage VR1, the second terminal of the first transistor MIA is coupled to the first output terminal of the comparator 142, and the control terminal of the first transistor MIA is coupled to the first terminal of the first transistor M1A.

The second transistor M2A has a first terminal, a second terminal and a control terminal. The first terminal of the second transistor M2A may receive the first system voltage VR1, the second terminal of the second transistor M2A is coupled to the second terminal of the first transistor M1A, and the control terminal of the second transistor M2A is coupled to the second output terminal of the comparator 142.

The third transistor M3A has a first terminal, a second terminal and a control terminal. The first terminal of the third transistor M3A may receive the first system voltage VR1, the second terminal of the third transistor M3A is coupled to the control terminal of the second transistor M2A, and the control terminal of the third transistor M3A is coupled to the first terminal of the third transistor M3A.

The fourth transistor M4A has a first terminal, a second terminal and a control terminal. The first terminal of the fourth transistor M4A may receive the first system voltage VR1, the second terminal of the fourth transistor M4A is coupled to the control terminal of the second transistor M2A, and the control terminal of the fourth transistor M4A is coupled to the second terminal of the second transistor M2A.

The fifth transistor M5A has a first terminal, a second terminal and a control terminal. The first terminal of the fifth transistor M5A is coupled to the second terminal of the first transistor M1A, and the control terminal of the fifth transistor M5A is coupled to the first input terminal of the comparator 142.

The sixth transistor M6A has a first terminal, a second terminal and a control terminal. The first terminal of the sixth transistor M6A is coupled to the second terminal of the third transistor M3A, the second terminal of the sixth transistor M6A is coupled to the second terminal of the fifth transistor M5A, and the control terminal of the sixth transistor M6A is coupled to the second input terminal of the comparator 142.

The seventh transistor M7A has a first terminal, a second terminal and a control terminal. The first terminal of the seventh transistor M7A is coupled to the second terminal of the fifth transistor M5A, and the control terminal of the seventh transistor M7A may receive a reset signal $SIG_{RST}$.

In addition, in the embodiment in FIG. 3, the comparator 142 may further comprise a tenth transistor M10A. The tenth transistor M10A has a first terminal, a second terminal and a control terminal. The first terminal of the tenth transistor M10A is coupled to the second terminal of the seventh transistor M7A, the second terminal of the tenth transistor M10A may receive the second system voltage VR2, and the control terminal of the tenth transistor M10A may receive an inverted light emission control signal $SIG_{EM1B}$. However in some embodiments, the tenth transistor M10A may be omitted from the comparator 142, in the case as such, the second terminal of the seventh transistor M7A may receive the second system voltage VR2.

In the embodiment of the disclosure, the first system voltage VR1 may exceed the second system voltage VR2. For example, the first system voltage VR1 may be and is not limited to an operation voltage of the system, and the second system voltage VR2 may be and is not limited to a ground voltage of the system. Further, the inverted light emission control signal $SIG_{EM1B}$ and the light emission control signal $SIG_{EM1}$ may be two voltage signals opposite in polarity.

In the embodiment in FIG. 1 (also refer to FIG. 3), the switch component 160 may comprise an eighth transistor M8A and a first storage device CIA, and the switch component 150 may comprise a ninth transistor M9A.

The eighth transistor M8A has a first terminal, a second terminal and a control terminal. The first terminal of the eighth transistor M8A is coupled to the first data line DTA1, the second terminal of the eighth transistor M8A may be coupled to the first terminal of the pulse modulation unit 140, and the control terminal of the eighth transistor M8A is coupled to the scan line SC1.

The first storage device CIA has a first terminal and a second terminal. The first terminal of the first storage device CIA is coupled to the second terminal of the eighth transistor M8A, and the second terminal of the first storage device CIA may receive the second system voltage VR2.

The ninth transistor M9A has a first terminal, a second terminal and a control terminal. The first terminal of the ninth transistor M9A is coupled to the first terminal of the switch component 150, the second terminal of the ninth transistor M9A is coupled to the second terminal of the switch component 150, and the control terminal of the ninth transistor M9A may receive the light emission control signal $SIG_{EM1}$.

In addition, in some embodiments, the comparator 142 may further comprise an eleventh transistor M11A. The eleventh transistor M11A has a first terminal, a second terminal and a control terminal. The first terminal of the eleventh transistor M11A may receive the first system voltage VR1, the second terminal of the eleventh transistor M11A is coupled to the second output terminal of the comparator 142, and the control terminal of the eleventh transistor M11A may receive the inverted light emission control signal $SIG_{EM1B}$.

In addition, in the embodiment in FIG. 3, the first transistor M1A, the third transistor M3A, the fifth transistor M5A, the sixth transistor M6A, the seventh transistor M7A and the tenth transistor M10A may be, for example, N-type transistors, and the second transistor M2A, the fourth transistor M4A, the eighth transistor M8A, the ninth transistor M9A and the eleventh transistor M11A may be, for example, P-type transistors.

In some embodiments, since the variation comparison signal $SIG_{CS1}$ may be generated continuously by an external waveform generator, and may be shared by all light-emitting driving circuits 100 (1,1) through 100 (M,N) on the substrate 12, the comparator 142 in the light-emitting driving circuit 100 (1,1) may control timing of the comparator 142 performing a comparison via the transistors M9A and M8A in the first and second switch component 150, 160.

Figure 4:
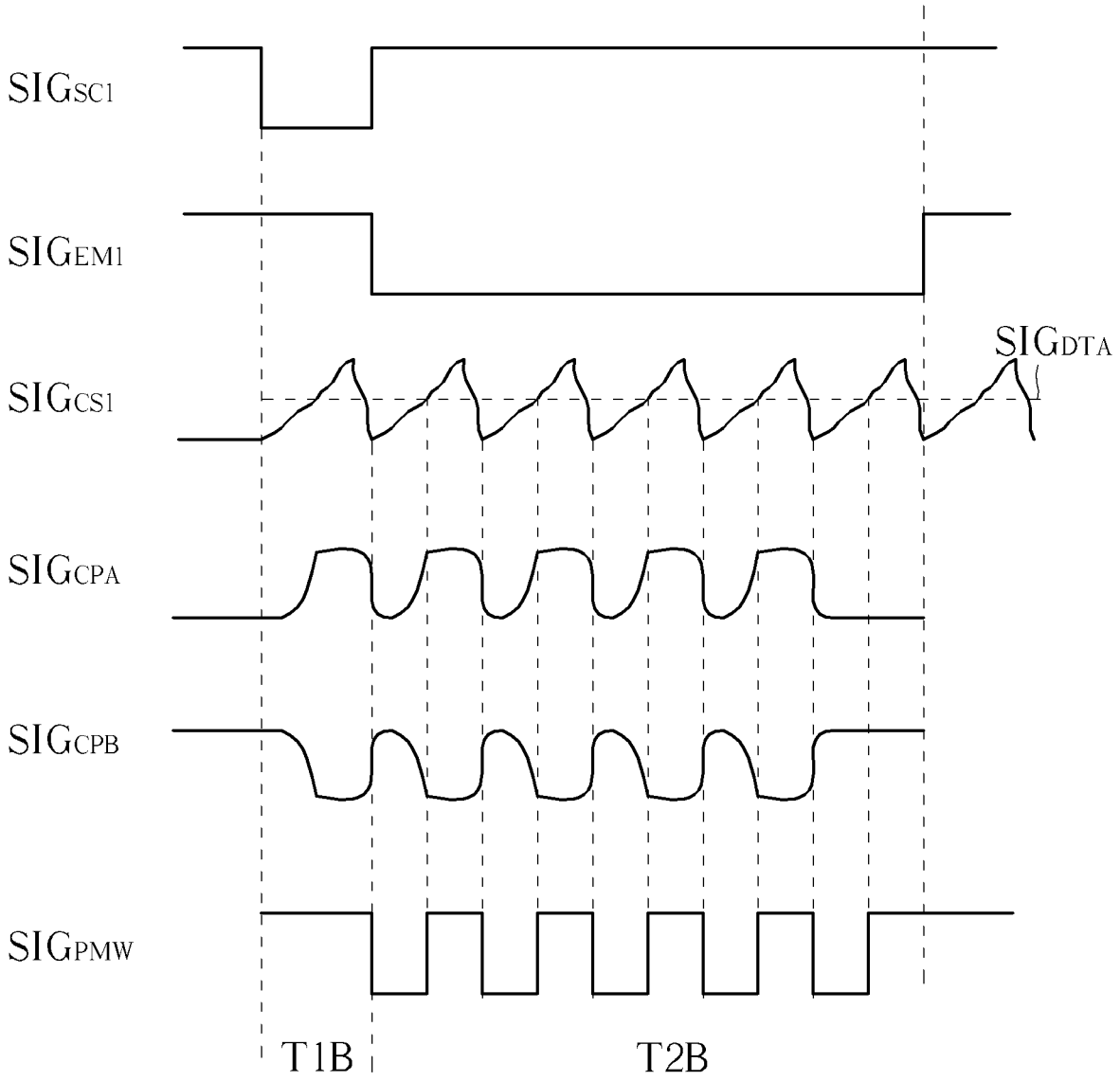
FIG. 4 is a signal diagram of the pulse modulation unit in FIG. 3.

FIG. 4 is a signal diagram of the pulse modulation unit 140. In the time interval T1B, the scan signal $SIG_{SC1}$ may be set at a low voltage level to turn on the eighth transistor M8A to charge the first storage device CIA to a corresponding voltage using the emission data signal $SIG_{DTA1}$. Next in the time interval T2B, the scan signal $SIG_{SC1}$ may be set at a high voltage level, and the light emission control signal $SIG_{EM1}$ may be set at the low voltage level to turn on the ninth transistor M9A. Further, the reset signal $SIG_{RST}$ may be set at the high voltage level to turn on the seventh transistor M7A, and the inverted light emission control signal $SIG_{EM1B}$ may be set at the high voltage level to turn on the tenth transistor M10A. Therefore, in the time interval T2B, the fifth transistor M5A and the sixth transistor M6A may generate currents having different magnitudes according to the voltages of the emission data signal $SIG_{DTA1}$ and the variation comparison signal $SIG_{CS1}$, and in turn, change the bias voltages of the second transistor M2A and the fourth transistor M4A, and output the first comparison signal $SIG_{CPA}$ and the second comparison signal $SIG_{CPB}$ that are opposite in polarity.

Moreover, in some embodiments, when the light emission control signal $SIG_{EM1}$ is set to the high voltage level to turn off the ninth transistor M9A, and the inverted light emission control signal $SIG_{EM1B}$ is set at the low voltage level to turn off the tenth transistor M10A and turn on the eleventh transistor M11A, the eleventh transistor M11A may fix the voltage level at the second output terminal of the comparator 142 to the first system voltage VR1, to fix the output of the voltage shifter circuit 144 at a fixed voltage level and prevent the voltage shifter circuit 144 from generating an incorrect emission duration modulation signal $SIG_{PWM}$, and the pulse modulation unit 140 may be disabled.

When the voltage level of the emission data signal $SIG_{DTA1}$ is less than the voltage level of the variation comparison signal $SIG_{CS1}$, the sixth transistor M6A is turned on to a greater degree than the fifth transistor M5A and generates a larger current than the fifth transistor M5A, to pull down the second comparison signal $SIG_{CPB}$ output at the second output terminal of the comparator 142 to close to the second system voltage VR2, while the second transistor M2A is turned on to pull up the first comparison signal $SIG_{CP4}$ to close to the first system voltage VR1. Conversely, as the voltage level of the variation comparison signal $SIG_{CS1}$ gradually decreases, the voltage level of the emission data signal $SIG_{DT41}$ will exceed the voltage level of the variation comparison signal $SIG_{CS1}$, and the fifth transistor M5A will be turned on to a greater degree than the fifth transistor M6A and generate a larger current than the fifth transistor M6A, to pull down the first comparison signal $SIG_{CP4}$ output at the first output terminal of the comparator 142 to close to the second system voltage VR2, while the second comparison signal $SIG_{CPB}$ is pulled up to close to the first system voltage VR1. Further, in FIG. 4, the variation comparison signal $SIG_{CS1}$ has a sawtooth waveform, the rising edge has a gradual voltage transition and not a sharp and steady upward transition, and is not limited to the waveform of the variation comparison signal $SIG_{CS1}$ as in FIG. 4. In another embodiment of the disclosure, the rising edge of the variation comparison signal $SIG_{CS1}$ may be a substantially sharper upward transition, i.e., the voltage ripple variation is reduced, to the extent that the voltage ripple variation may be ignored, increasing efficiency of the comparator 142 outputting signals and converting voltages. Furthermore, circuit developers may select other waveforms of the variation comparison signal $SIG_{CS1}$ such as and not limited to a sinusoidal signal.

In some embodiments, the light-emitting electronic device 10 may comprise a waveform generation circuit configured to generate the variation comparison signal $SIG_{CS1}$. For example, the waveform generation circuit may be arranged at the peripheral area of the substrate 12 such as a neighboring area of the driving circuit generating the emission data signal $SIG_{DT41}$ or the scan signal $SIG_{SC1}$, or is integrated with the driving circuit. In addition, the waveform generation circuit may be arranged on a power board or a control board of the light-emitting electronic device 10, or arranged on the substrate 12 byway of a chip on film (COF) package or a chip on glass (COG) package.

The comparator 142 generates the first comparison signal $SIG_{CP4}$ and the second comparison signal $SIG_{CPB}$, the voltage shifter circuit 144 may further adjust the voltages and waveforms of the first comparison signal $SIG_{CP4}$ and the second comparison signal $SIG_{CPB}$, and generate the required emission duration modulation signal $SIG_{PWM}$. In FIG. 3, the voltage shifter circuit 144 may comprise a twelfth transistor M12A through a seventeenth transistor M17A and an inverter INV.

The twelfth transistor M12A has a first terminal, a second terminal and a control terminal. The first terminal of the twelfth transistor M12A may receive the first system voltage VR1, and the control terminal of the twelfth transistor M12A is coupled to the first output terminal of the comparator 142.

The thirteenth transistor M13A has a first terminal, a second terminal and a control terminal. The first terminal of the thirteenth transistor M13A may receive the first system voltage VR1, and the control terminal of the thirteenth transistor M13A is coupled to the second output terminal of the comparator 142.

The fourteenth transistor M14A has a first terminal, a second terminal and a control terminal. The first terminal of the fourteenth transistor M14A is coupled to the second terminal of the twelfth transistor M12A, and the control terminal of the fourteenth transistor M14A is coupled to the second terminal of the thirteenth transistor M13A.

The fifteenth transistor M15A has a first terminal, a second terminal and a control terminal. The first terminal of the fifteenth transistor M15A is coupled to the second terminal of the thirteenth transistor M13A, and the control terminal of the fifteenth transistor M15A is coupled to the second terminal of the twelfth transistor M12A.

The sixteenth transistor M16A has a first terminal, a second terminal and a control terminal. The first terminal of the sixteenth transistor M16A is coupled to the second terminal of the fourteenth transistor M14A, the second terminal of the sixteenth transistor M16A may receive the second system voltage VR2, and the control terminal of the sixteenth transistor M16A is coupled to the control terminal of the twelfth transistor M12A.

The seventeenth transistor M17A has a first terminal, a second terminal and a control terminal. The first terminal of the seventeenth transistor M17A is coupled to the second terminal of the fifteenth transistor M15A, the second terminal of the seventeenth transistor M17A may receive the second system voltage VR2, and the control terminal of the seventeenth transistor M17A is coupled to the control terminal of the thirteenth transistor M13A.

The inverter INV has an input terminal and an output terminal. The input terminal of the inverter INV is coupled to the second terminal of the twelfth transistor M12A, and the output terminal of the inverter INV may output the emission duration modulation signal $SIG_{PWM}$.

In the embodiment in FIG. 3, the twelfth transistor M12A and the thirteenth transistor M13A may be P-type transistors, and the fourteenth transistor M14A, the fifteenth transistor M15A, the sixteenth transistor M16A and the seventeenth transistor M17A may be N-type transistors. The twelfth transistor M12A through the seventeenth transistor M17A and the inverter INV are employed to sharpen the first comparison signal $SIG_{CP4}$ and the second comparison signal $SIG_{CPB}$, resulting in an emission duration modulation signal $SIG_{PWM}$ closer to a pulse modulation signal.

Further in FIG. 3, the sixteenth transistor M16A and the seventeenth transistor M17A may generate in real time a pull-down current according to the first comparison signal $SIG_{CP4}$ and the second comparison signal $SIG_{CPB}$, resulting in a sharper rising edge and falling edge of the emission duration modulation signal $SIG_{PWM}$, thereby enhancing luminance resolution of the light-emitting component 110 such as the grayscale resolution. In some embodiments where the waveform of the emission duration modulation signal has been already compliant with the requirement, the sixteenth transistor M16A and the seventeenth transistor M17A may be omitted, and the respective second terminals of the fourteenth transistor M14A and the fifteenth transistor M15A may receive the second system voltage VR2.

Since the pulse modulation unit 140 may compare the emission data signal $SIG_{DT41}$ and the variation comparison signal $SIG_{CS1}$ to generate the emission duration modulation signal $SIG_{PWM}$, the light-emitting driving circuit 100(1,1) may utilize the emission duration modulation signal $SIG_{PWM}$ to adjust a light emission period of the light-emitting component 110, achieving various luminance levels. In the situation as such, since the light-emitting component 110 in the light-emitting driving circuit 100(1,1) may be driven by the constant driving current $I_D$, color shift produced by the light-emitting component 110 is reduced.

Moreover, in some embodiments of the disclosure, since the light-emitting driving circuits on the substrate 12 and coupled to different scan lines and different light emission control lines may be selected during different time intervals to emit light, thus the pulse modulation units in different light-emitting driving circuits may share a voltage shifter circuit 144. For example, the light-emitting driving circuit 100(2,1) and the light-emitting driving circuit 100(1,1) are respectively coupled to the scan lines SC1 and SC2, and respectively coupled to different light emission control lines EM1 and EM2, i.e., the light-emitting driving circuit 100(2,1) and the light-emitting driving circuit 100(1,1) may be selected in different time intervals. In such a case, the light-emitting driving circuit 100(1,1) may comprise the comparator 142, and the light-emitting driving circuit 100(2,1) and the light-emitting driving circuit 100(1,1) may employ time-division multiplexing to share the voltage shifter circuit 144 in the light-emitting driving circuit 100(1,1). However, the disclosure is not limited to the light-emitting driving circuits employing time-division multiplexing to share a voltage shifter circuit, each of the light-emitting driving circuits 100(1,1) through 100(M,N) may have separate and independent pulse modulation units.

Figure 5:
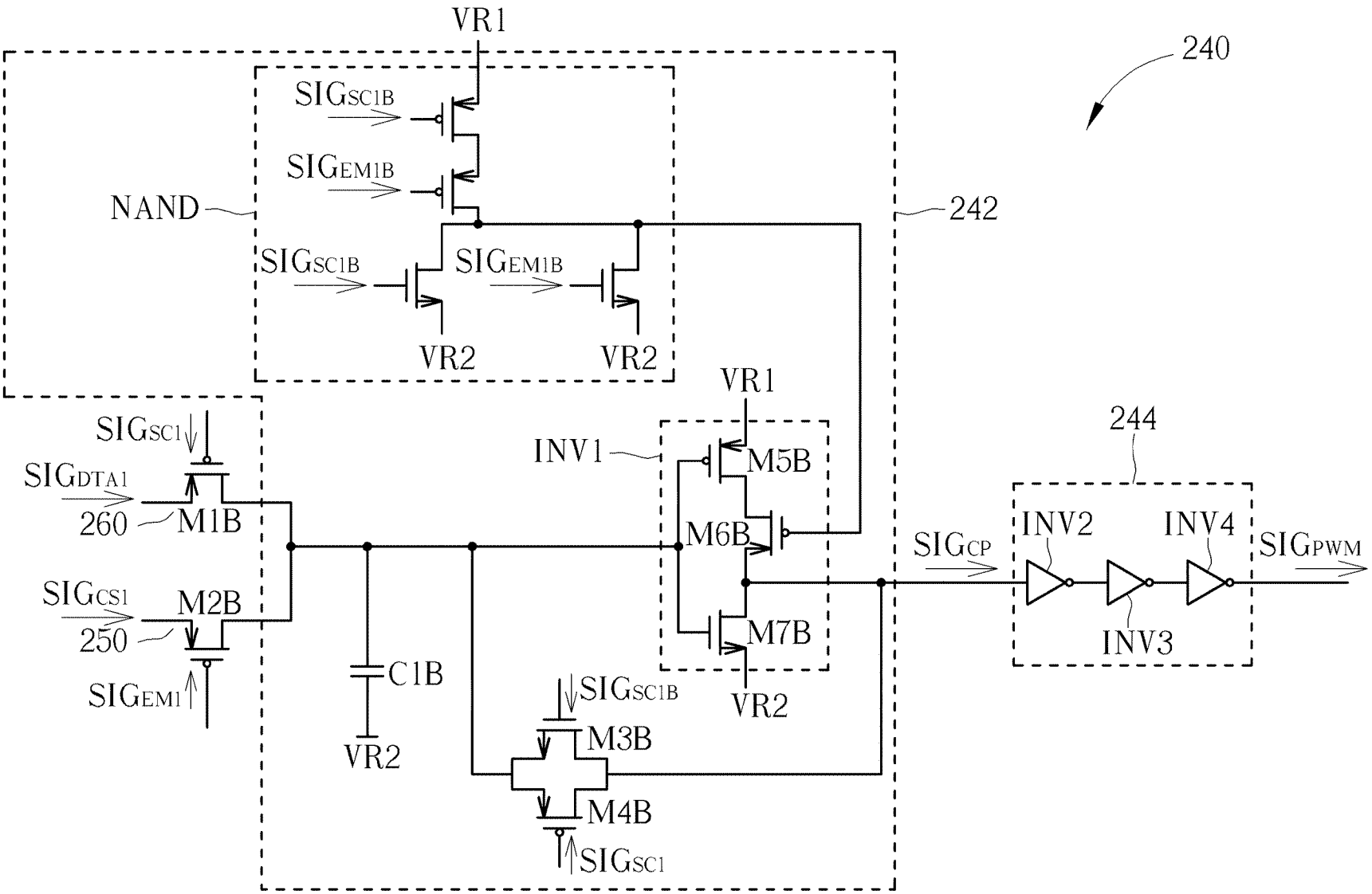
FIG. 5 is a schematic diagram of the pulse modulation unit in FIG. 1 according to another embodiment of the disclosure.

FIG. 5 is a schematic diagram of the pulse modulation unit 240 according to another embodiment of the disclosure. The pulse modulation unit 240 may be applied in the light-emitting driving circuit 100(1,1) to replace the pulse modulation unit 140. In FIG. 5, the pulse modulation unit 240 may comprise a comparator 242 and a waveform reshaper 244.

The comparator 242 has a first input terminal, a second input terminal and an output terminal. The first input terminal of the comparator 242 may be coupled to the first terminal of the pulse modulation unit 240 to receive the emission data signal $SIG_{DTA1}$, the second input terminal of the comparator 242 may be coupled to the second terminal of the pulse modulation unit 240 to receive the variation comparison signal $SIG_{CS1}$, and the comparator 242 may compare the emission data signal $SIG_{DTA1}$ and the variation comparison signal $SIG_{CS1}$ to output a comparison signal $SIG_{CP}$ at the output terminal of the comparator 242. The waveform reshaper 244 may be coupled to the output terminal of the comparator 242, and may sharpen the waveform of the comparison signal $SIG_{CP}$ to generate the emission duration modulation signal $SIG_{PWM}$.

In the embodiment in FIG. 5, the switch component 260 may comprise a first transistor M1B, and the switch component 250 may comprise a second transistor M2B. The first transistor M1B has a first terminal, a second terminal and a control terminal. The first terminal of the first transistor M1B is coupled to the first data line DTA1, the second terminal of the first transistor M1B is coupled to the first terminal of the comparator 242, and the control terminal of the first transistor M1B is coupled to the scan line SC1.

The second transistor M2B has a first terminal, a second terminal and a control terminal. The first terminal of the second transistor M2B is coupled to the comparison signal line CS1, the second terminal of the second transistor M2B is coupled to the second terminal of the comparator 242, and the control terminal of the second transistor M2B may receive the light emission control signal $SIG_{EM1}$.

That is, the switch components 250 and 260 may respectively control the comparator 242 according to the light-emission control signal $SIG_{EM1}$ and the scan signal $SIG_{SC1}$ to receive the variation comparison signal $SIG_{CS1}$ and the emission data signal $SIG_{DTA1}$ at the appropriate time.

The comparator 242 comprises a third transistor M3B and a fourth transistor M4B, a second storage component C1B and a first inverter INV1.

The first inverter INV1 has an input terminal and an output terminal. The input terminal of the first inverter INV1 is coupled to the first input terminal and the second input terminal of the comparator 242, and the output terminal of the first inverter INV1 is coupled to the output terminal of the comparator 242.

The second storage component C1B has a first terminal and a second terminal. The first terminal of the second storage component C1B is coupled to the input terminal of the first inverter INV1, and the second terminal of the second storage component C1B may receive the second system voltage VR2.

The third transistor M3B has a first terminal, a second terminal and a control terminal. The first terminal of the third transistor M3B is coupled to the output terminal of the first inverter INV1, the second terminal of the third transistor M3B is coupled to the input terminal of the first inverter INV1, and the control terminal of the third transistor M3B may receive the inverted scan signal $SIG_{SC1B}$ that is opposite in polarity to the scan signal $SIG_{SC1}$.

The fourth transistor M4B has a first terminal, a second terminal and a control terminal. The first terminal of the fourth transistor M4B is coupled to the output terminal of the first inverter INV1, the second terminal of the fourth transistor M4B is coupled to the input terminal of the first inverter INV1, and the control terminal of the fourth transistor M4B is coupled to the scan line SC1.

Figure 6:
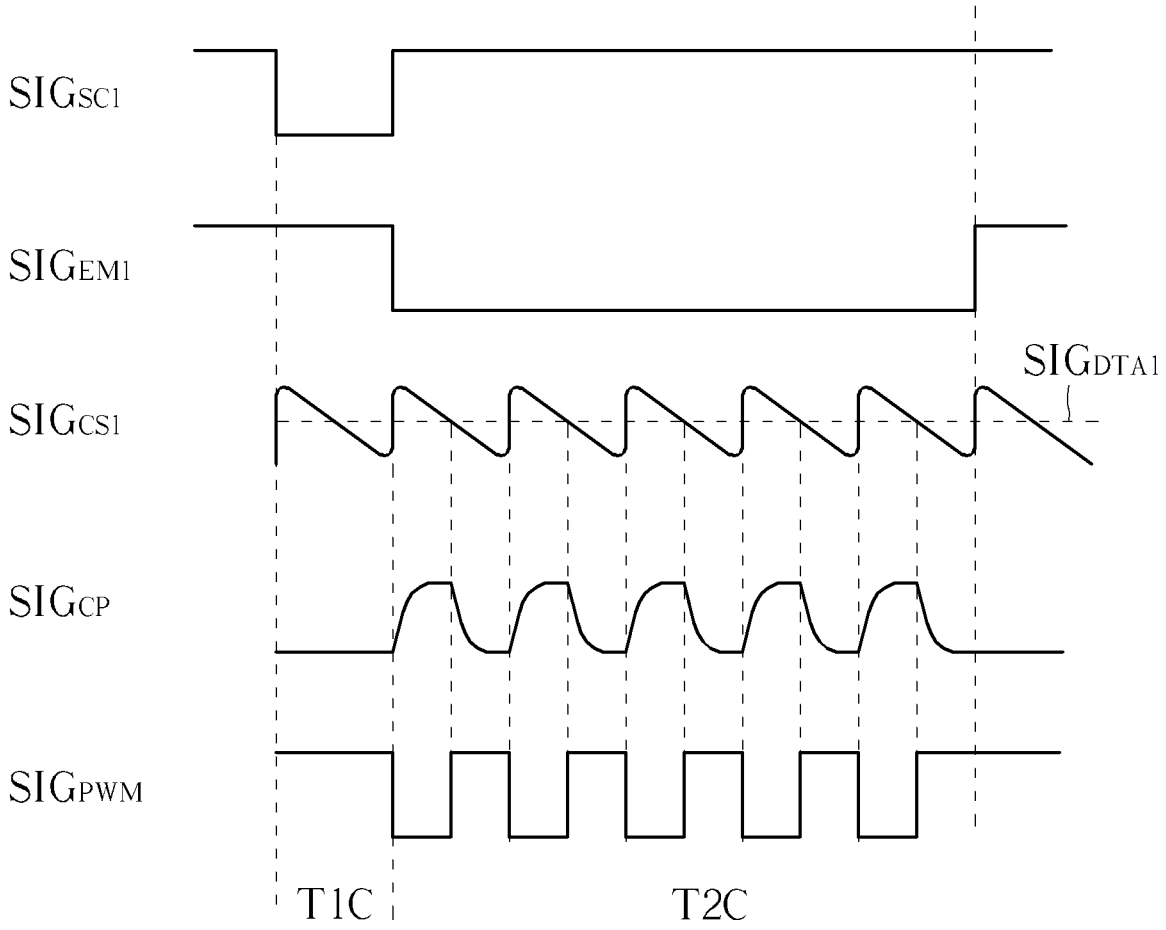
FIG. 6 is a waveform diagram of signals of the pulse modulation unit in FIG. 5.

In the embodiment in FIG. 5, the first transistor M1B, the second transistor M2B and the fourth transistor M4B may be P-type transistors, and the third transistor M3B may be an N-type transistor. FIG. 6 is a signal diagram of the pulse modulation unit 240. In the time interval TIC in FIG. 6, the scan signal $SIG_{SC1}$ may be set at a low voltage level to turn on the first transistor M1B to charge the second storage component C1B to a corresponding voltage using the emission data signal $SIG_{DTA1}$. Since the third transistor M3B and the fourth transistor M4B are also turned on, the input terminal and the output terminal of the first inverter INV1 are maintained at an identical voltage, and the pull-up transistor and the pull-down transistor in the first inverter INV1 are simultaneously turned on, and therefore, the input terminal and the output terminal of the first inverter INV1 are maintained at intermediate voltages.

Next in the time interval T2C, the scan signal $SIG_{SC1}$ may be set at a high voltage level and the light emission control signal $SIG_{EM1}$ may be set at the low voltage level to turn on the second transistor M2B and turn off the third transistor M3B and the fourth transistor M4B. The voltage of the variation comparison signal $SIG_{CS1}$ and the voltage at the second storage component C1B are superimposed on each other, and depending on the change in the voltage of the variation comparison signal $SIG_{CS1}$, the voltage at the first terminal of the second storage component C1B will rise or drop, and as a result, the first inverter INV1 will no longer output the intermediate voltage level but alternate between the high voltage level and the low voltage level. The voltage level of the emission data signal $SIG_{DTA1}$, or the voltage level charging the second storage component C1B, will affect the durations in which the first inverter INV1 is set to the high voltage level and the low voltage level during the time interval T2C.

In addition, in order to disable the comparator 242 to prevent the comparator 242 from performing a false operation during a non-scanning and a non-light-emitting time intervals, in some embodiments of the disclosure, the comparator 242 may further comprise a NAND gate to control the first inverter INV1.

The NAND gate has a first input terminal, a second input terminal and an output terminal. The first input terminal of the NAND gate may receive the inverted scan signal $SIG_{SC1B}$, and the second input terminal of the NAND gate may receive the inverted light emission control signal $SIG_{EM1B}$ that is opposite in polarity to the light emission control signal $SIG_{EM1}$.

In such a case, the first inverter INV1 may comprise a fifth transistor M5B, a sixth transistor M6B and a seventh transistor M7B.

The fifth transistor M5B has a first terminal, a second terminal and a control terminal. The first terminal of the fifth transistor M5B may receive the first system voltage VR1, and the control terminal of the fifth transistor M5B is coupled to the input terminal of the first inverter INV1.

The sixth transistor M6B has a first terminal, a second terminal and a control terminal. The first terminal of the sixth transistor M6B is coupled to the second terminal of the fifth transistor M5B, the second terminal of the sixth transistor M6A is coupled to the output terminal of the first inverter INV1, and the control terminal of the sixth transistor M6A is coupled to the output terminal of the NAND gate.

The seventh transistor M7B has a first terminal, a second terminal and a control terminal. The first terminal of the seventh transistor M7B is coupled to the second terminal of the sixth transistor M6B, the second terminal of the seventh transistor M7B may receive the second system voltage VR2, and the control terminal of the seventh transistor M7B is coupled to the control terminal of the fifth transistor M5B.

In FIG. 5, the fifth transistor M5B and the sixth1 transistor M6B may be P-type transistors, and the seventh transistor M7B may be an N-type transistor. Therefore, during the non-scanning and non-light-emitting time intervals, since the inverted scan signal $SIG_{SC1B}$ is set at the low voltage level and the inverted light emission control signal $SIG_{EM1B}$ is set at the low voltage level, the output terminal of the NAND gate is set at the high voltage level, and consequently, the sixth transistor M6B is turned off, stopping the first inverter INV1 from performing the phase inversion operation. Conversely, during the scanning and light-emitting time intervals, the inverted scan signal $SIG_{SC1B}$ is set at the high voltage level and the inverted light emission control signal $SIG_{EM1B}$ is set at the high voltage level, and therefore, the output terminal of the NAND gate is set at the low voltage level, the sixth transistor M6B is turned on, enabling the first inverter INV1 to perform the phase inversion operation.

Although the comparator 242 may compare the emission data signal $SIG_{DTA1}$ and the variation comparison signal $SIG_{CS1}$ to output the comparison signal $SIG_{CP}$ switching between the high voltage level and the low voltage level, the speed of comparison signal $SIG_{CP}$ switching between voltage levels is slower, and thus the pulse modulation unit 240 may adjust the waveform of the comparison signal $SIG_{CP}$ using the waveform shaper 244.

In FIG. 5, the waveform reshaper 244 may comprise a second inverter INV2, a third inverter INV3 and a fourth inverter INV4.

The second inverter INV2 has an input terminal and an output terminal. The input terminal of the second inverter INV2 is coupled to the output terminal of the comparator 242. The third inverter INV3 has an input terminal and an output terminal. The input terminal of the third inverter INV3 is coupled to the output terminal of the second inverter INV2. The fourth inverter INV4 has an input terminal and an output terminal. The input terminal of the fourth inverter INV4 is coupled to the output terminal of the third inverter INV3, and the output terminal of the fourth inverter INV4 may output the emission duration modulation signal $SIG_{PWM}$.

The second inverter INV2, the third inverter INV3 and the fourth inverter INV4 may be employed to output, according to the comparison signal $SIG_{CP}$, the emission duration modulation signal $SIG_{PWM}$ having a sharper rising edge and falling edge, driving the light-emitting component 110 in the light-emitting driving circuits 100(1,1) according to a constant driving current $I_D$, and reducing color shift.

Further, the waveform of the variation comparison signal $SIG_{CS1}$ in FIG. 6 is different from that in FIG. 4. In FIG. 6, the rising edge of the variation comparison signal $SIG_{CS1}$ may has a substantially sharp upward transition, i.e., the voltage ripple variation is reduced, increasing efficiency of the comparator 242 outputting signals and converting voltages. In other words, FIG. 4 and FIG. 6 merely provide exemplary waveforms of the variation comparison signal $SIG_{CS1}$, and choosing different types of waveform generators based on the requirements to generate different waveforms of the variation comparison signal $SIG_{CS1}$ or irregular deformation in the waveforms of the variation comparison signal resulting from the characteristics of hardware components are within the scope of the disclosure.

Figure 7:
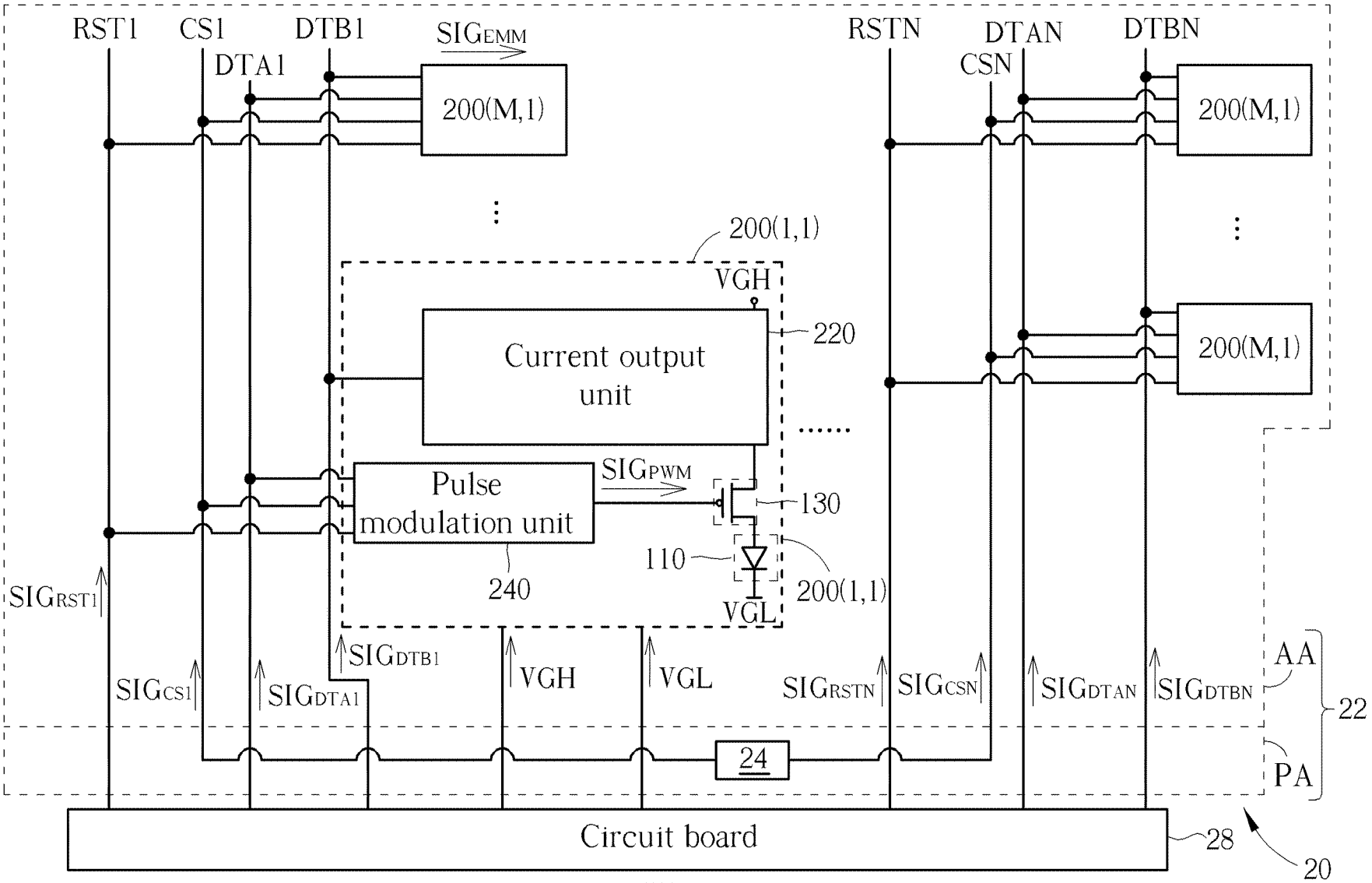
FIG. 7 is a schematic diagram of an electronic device 20 according to an embodiment of the disclosure

FIG. 7 is a schematic diagram of an electronic device 20 according to an embodiment of the disclosure. The electronic device 20 and the electronic device 10 have similar structures and may be operated according to a similar principle. However, the electronic device 20 further comprises a waveform generation unit 24 and a circuit board 28. In FIG. 7, light-emitting driving circuits 200 (1,1) through 200 (M,N) may be deposited in an active area AA of the substrate 22. The waveform generation unit 24 may be disposed at a peripheral area PA outside the active area AA of the substrate 22. The waveform generation unit 24 is configured to generate a variation comparison signal $SIG_{CS1}$. In some embodiments, the substrate 22 may be a transparent material such as a glass material or a resin material. The waveform generation unit 24 may be disposed on the substrate 12 by way of chip-on-film (COF) packages or chip-on-glass (COG) packages.

The circuit board 28 may be disposed outside the substrate 22, and may generate a high operation voltage VGH and a low operation voltage VGL required by the light-emitting driving circuits 200 (1,1) through 200 (M,N) in the electronic device 20, and may generate predetermined data signals $SIG_{DTB1}$ through $SIG_{DTBN}$, light-emitting data signals $SIG_{DTA1}$ through $SIG_{DTAN}$, and reset signals $SIG_{RST1}$ through $SIG_{RSTN}$. In some embodiments, the high operation voltage VGH may be an operation voltage for use to turn on an N-type transistor, and the low operation voltage VGL may be an operation voltage for use to turn off an N-type transistor. Further, the electronic device 20 may transmit the reset signals $SIG_{RST1}$ through $SIG_{RSTN}$ via reset signal lines RST1 through RSTN, so as to reset pulse modulation units 240 in the light-emitting driving circuits 200 (1,1) through 200 (M,N).

In some embodiments, the circuit board 28 may generate the light-emitting data signals $SIG_{DTA1}$ through $SIG_{DTAN}$ according to pixel values and a gamma correction table. For example, the circuit board 28 may look up the gamma correction table according to pixel values corresponding to image contents to generate corresponding light-emitting data signals $SIG_{DTA1}$ through $SIG_{DTAN}$. Since perception of brightness in human eyes is nonlinear, the corresponding light-emitting data signals $SIG_{DTA1}$ through $SIG_{DTAN}$ may be obtained using the gamma correction table so as to drive the light-emitting driving circuits 200 (1,1) through 200 (M,N) to produce an image better perceived by human eyes. Moreover, in some embodiments, the circuit board 28 may further perform a demura operation to reduce a level of non-uniformity in an image, producing suitable light-emitting data signals $SIG_{DTA1}$ through $SIG_{DTAN}$, and reducing non-uniform defects in an image produced by the light-emitting driving circuits 200 (1,1) through 200 (M,N).

Figure 8:
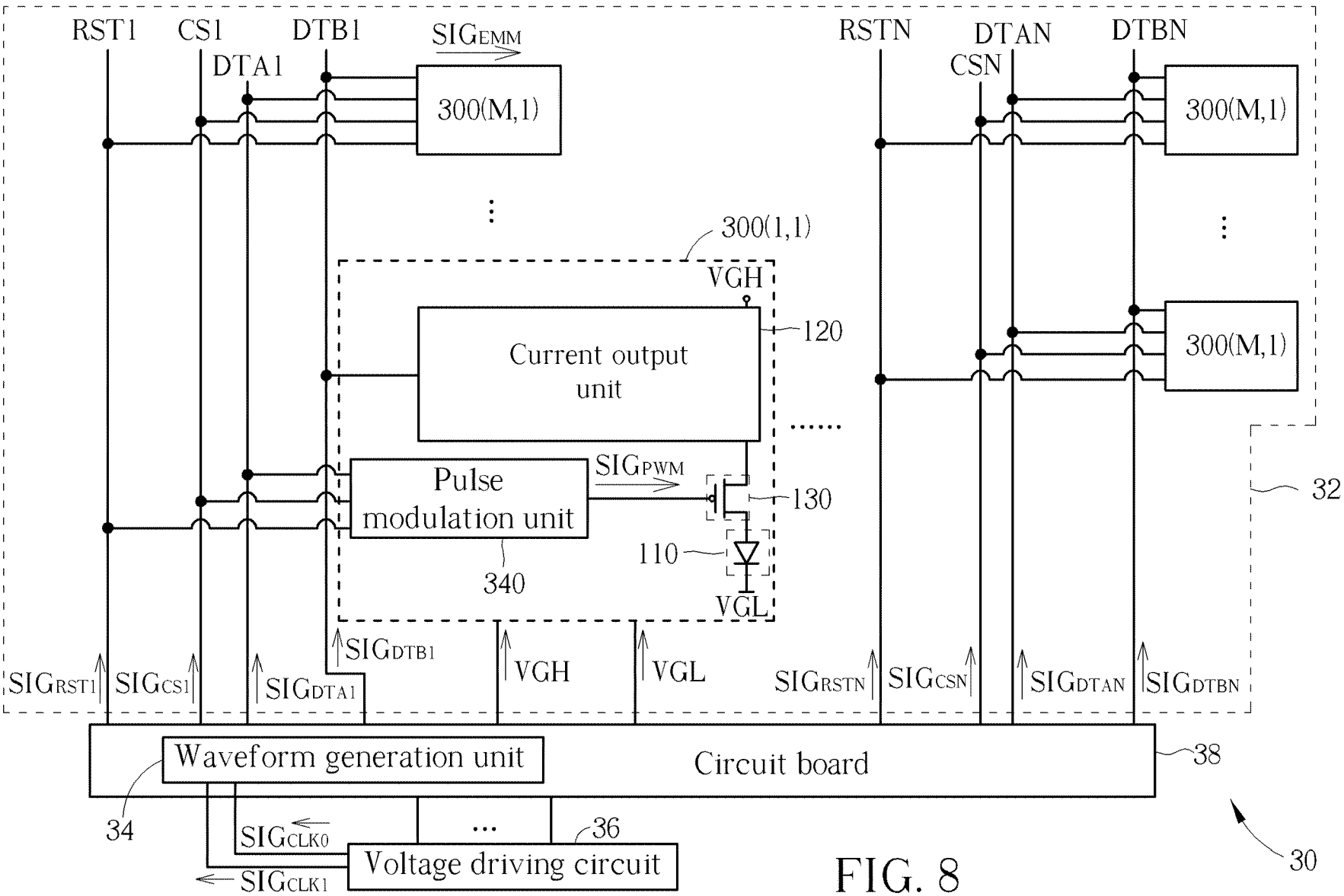
FIG. 8 is a schematic diagram of an electronic device 30 according to an embodiment of the disclosure.

FIG. 8 is a schematic diagram of an electronic device 30 according to an embodiment of the disclosure. The electronic device 30 and the electronic device 20 have similar structures and may be operated according to a similar principle. The circuit board 38 may be disposed outside the substrate 32. The electronic device 30 may further comprise a voltage generation circuit 36 coupled to the circuited board 38. In such a case, a waveform generation unit 34 may be disposed in the circuit board 38 to reduce circuit components in the substrate 32, simplifying a circuit design of the electronic device 30. Furthermore, the voltage generation circuit 36 may generate clock signals $SIG_{CLK0}$ and $SIG_{CLK1}$ for the waveform generation unit 34 to adjust a required variation period. In an example for illustrative purpose but not for limiting purpose, clock signals $SIG_{CLK0}$ and $SIG_{CLK1}$ are input into the circuit board 38 to enable the waveform generation unit 34 to generate according to timing of the clock signals $SIG_{CLK0}$ and $SIG_{CLK1}$ to generate corresponding variation comparison signals $SIG_{CS1}$ through $SIG_{CSN}$ corresponding to amplitudes and phases.

Figure 9:
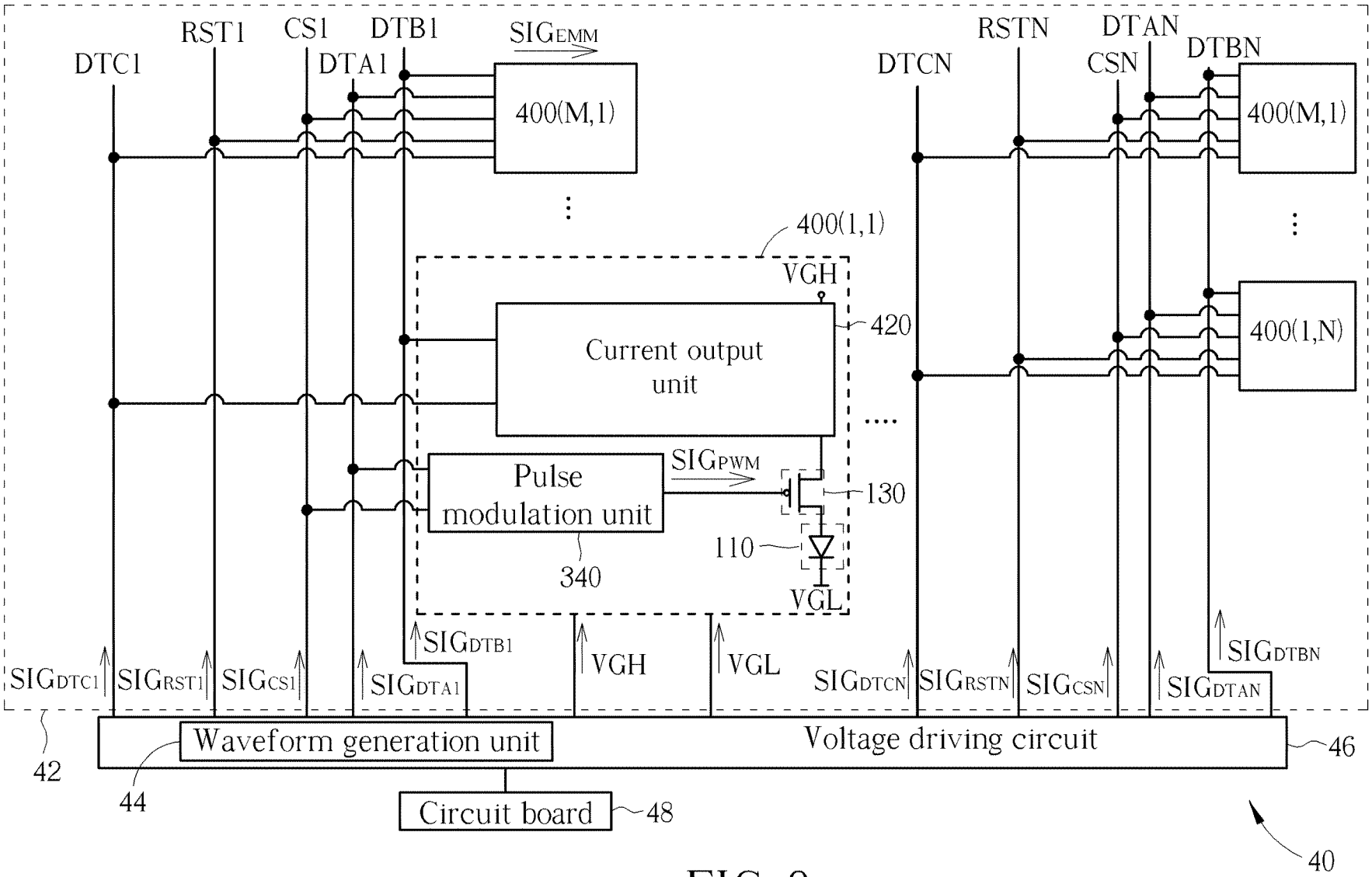
FIG. 9 is a schematic diagram of an electronic device 40 according to an embodiment of the disclosure.

FIG. 9 is a schematic diagram of an electronic device 40 according to an embodiment of the disclosure. The electronic device 40 and the electronic device 30 have similar structures and may be operated according to a similar principle. In the electronic device 40, a waveform generation unit 44 may be disposed in a voltage driving circuit 46 and not in a circuit board 48. Since the waveform generation unit 44 may similarly be disposed in a system circuit board outside a substrate 42, circuit components in the substrate 42 may similarly be reduced for the electronic device 40, reducing complexity of a circuit design.

Further, in FIG. 9, the circuit board 48 provides required power to the electronic device, the voltage driving circuit 46 may generate light-emitting data signals $SIG_{DTC1}$ through $SIG_{DTCN}$ substantially identical to light-emitting data signals $SIG_{DTA1}$ through $SIG_{DTAN}$ according to pixel values and a gamma correction table, and current output units 420 of light-emitting driving circuits 400 (1,1) through 400 (M,N) may receive the light-emitting data signals $SIG_{DTC1}$ through $SIG_{DTCN}$ via third data lines DTC1 through DTTCN, and generate corresponding driving currents according to the predetermined data signals $SIG_{DTB1}$ through $SIG_{DTBN}$ and the light-emitting data signals $SIG_{DTC1}$ through $SIG_{DTCN}$.

For example, for a low brightness, the current output units 420 may generate fixed driving currents according to the predetermined data signals $SIG_{DTB1}$ through $SIG_{DTBN}$ to reduce a color shift of the light emitting component 110, and for a high brightness, the current output units 420 may generate driving currents having corresponding current magnitudes according to the light-emitting data signals $SIG_{DTC1}$ through $SIG_{DTCN}$ to drive the light emitting component 110. In doing so, the brightness produced by the light-emitting driving circuits 400 (1,1) through 400 (M,N) may be better controlled.

Therefore, the display device in the disclosure may utilize a constant driving current to drive the light-emitting component in the light-emitting driving circuit, and may adjust using the pulse modulation unit the emission pulse duration of the light-emitting component, thereby addressing the issue in the prior art in which color shift is present when a light-emitting component is driven by a low current to provide low luminance.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. An electronic device comprising:

a substrate; and a plurality of light-emitting driving circuits disposed on the substrate, a first light-emitting driving circuit of the plurality of light-emitting driving circuits comprising:

a first switch component having a first terminal and a second terminal, the first terminal of the first switch component being coupled to a comparison signal line;

a pulse modulation unit having a first terminal and a second terminal, the first terminal of the pulse modulation unit being coupled to a first data line, and the second terminal of the pulse modulation unit being coupled to the second terminal of the first switch component;

a light-emitting component;

a current output unit coupled to a scan line and a second data line, and configured to receive a scan signal from the scan line, receive a predetermined data signal from the second data line, and generate a driving current having a constant magnitude according to the scan signal and the predetermined data signal; and a current switch unit coupled to the current output unit, the light-emitting component and the pulse modulation unit, and configured to receive an emission duration modulation signal, and modulate the driving current received by the light-emitting component according to the emission duration modulation signal to generate a emission pulse duration;

wherein when the pulse modulation unit receives a variation comparison signal from the comparison signal line via the first switch component and the pulse modulation unit receives an emission data signal from the first data line, the pulse modulation unit compares the emission data signal and the variation comparison signal to generate the emission duration modulation signal;

the predetermined data signal has a constant voltage; and the emission data signal has a voltage corresponding to luminance of the light-emitting component.

2. The electronic device of claim 1, wherein the current output unit comprises:

a sampling switch having a first terminal, a second terminal and a control terminal, the first terminal of the sampling switch being coupled to the second data line, and the control terminal of the sampling switch being coupled to the scan line;

a first storage device having a first terminal and a second terminal, the first terminal of the first storage device being coupled to the second terminal of the sampling switch, and the second terminal of the first storage device being configured to receive a first system voltage; and a driving component having a first terminal, a second terminal and a control terminal, the first terminal of the driving component being coupled to the second terminal of the first storage device, the second terminal of the driving component being configured to output the driving current, and the control terminal of the driving component being coupled to the second terminal of the sampling switch.

3. The electronic device of claim 2, wherein the current output unit further comprises:

a threshold voltage compensation component, coupled to the control terminal of the driving component, and configured to compensate a threshold voltage of the driving component.

4. The electronic device of claim 1, wherein the pulse modulation unit comprises:

a comparator having a first input terminal, a second input terminal, a first output terminal and a second output terminal, the first input terminal of the comparator being coupled to the first terminal of the pulse modulation unit to receive the emission data signal via a second switch component, the second input terminal of the comparator being coupled to the second terminal of the pulse modulation unit to receive the variation comparison signal via the first switch component, the comparator being configured to compare the emission data signal and the variation comparison signal to output a first comparison signal and a second comparison signal via the first output terminal and the second output terminal of the comparator respectively, and the first comparison signal and second comparison signal being opposite in polarity; and a voltage shifter circuit, coupled to the first output terminal and the second output terminal of the comparator, and configured to shift voltage levels of the first comparison signal and the second comparison signal to generate the emission duration modulation signal.

5. The electronic device of claim 4, wherein:

a second light-emitting driving circuit in the plurality of light-emitting driving circuits are coupled to an another scan line;

the second light-emitting driving circuit comprises a comparator; and the first light-emitting driving circuit and the second light-emitting driving circuit employ time-division multiplexing to share the voltage shifter circuit in the first light-emitting driving circuit.

6. The electronic device of claim 4, wherein:

the second switch component comprises:

a first transistor having a first terminal, a second terminal and a control terminal, the first terminal of the first transistor being coupled to the first data line, the second terminal of the first transistor being coupled to the first terminal of the pulse modulation unit, and the control terminal of the first transistor being coupled to the scan line; and a first storage device having a first terminal and a second terminal, the first terminal of the first storage device being coupled to the second terminal of the first transistor, and the second terminal of the first storage device being configured to receive a second system voltage; and the first switch component comprises a second transistor having a first terminal, a second terminal and a control terminal, the first terminal of the second transistor being coupled to the first terminal of the first switch component, the second terminal of the second transistor being coupled to the second terminal of the first switch component, the control terminal of the second transistor being configured to receive a light emission control signal.

7. The electronic device of claim 6, wherein a semiconductor of the first transistor and the second transistor comprises amorphous silicon, low-temperature polycrystalline silicon, metal oxide, or combination thereof.

8. The electronic device of claim 1, further comprising a waveform generation circuit, configured to generate the variation comparison signal, and integrated in a driver of the scan signal or a driver of the emission data signal or arranged on the substrate using chip-on-film or chip-on-glass packaging.

9. The electronic device of claim 1, wherein the predetermined data signal has a voltage variation range within plus or minus 10 percent of a value of the predetermined data signal.

10. The electronic device of claim 1, wherein the emission data signal has a voltage level less than a maximum voltage level of the variation comparison signal and exceeding a minimum voltage level of the variation comparison signal.

11. The electronic device of claim 1, wherein the variation comparison signal has a sawtooth waveform.

12. The electronic device of claim 11, wherein the sawtooth waveform has a rising edge having a substantially sharp upward transition.

13. The electronic device of claim 11, wherein the sawtooth waveform has a rising edge having a gradual upward transition.

14. The electronic device of claim 1, wherein the pulse modulation unit comprises:

a comparator having a first input terminal, a second input terminal and an output terminal, the first input terminal of the comparator being coupled to the first terminal of the pulse modulation unit to receive the emission data signal, the second input terminal of the comparator being coupled to the second terminal of the pulse modulation unit to receive the variation comparison signal, and the comparator being configured to compare the emission data signal and the variation comparison signal to output a comparison signal at the output terminal of the comparator; and a waveform reshaper, coupled to the output terminal of the comparator, and configured to sharpen the waveform of the comparison signal to generate the emission duration modulation signal.

15. The electronic device of claim 14, wherein:

the second switch component comprises:

a first transistor having a first terminal, a second terminal and a control terminal, the first terminal of the first transistor being coupled to the first data line, the second terminal of the first transistor being coupled to the first terminal of the comparator, and the control terminal of the first transistor being coupled to the scan line; and the first switch component comprises:

a second transistor having a first terminal, a second terminal and a control terminal, the first terminal of the second transistor being coupled to the comparison signal line, the second terminal of the second transistor being coupled to the second terminal of the comparator, the control terminal of the second transistor being configured to receive the light emission control signal.

16. The electronic device of claim 14, wherein the comparator comprises:

a first inverter having an input terminal and an output terminal, the input terminal of the first inverter being coupled to the first input terminal and the second input terminal of the comparator, and the output terminal of the first inverter being coupled to the output terminal of the comparator;

a third transistor having a first terminal, a second terminal and a control terminal, the first terminal of the third transistor being coupled to the output terminal of the first inverter, the second terminal of the third transistor being coupled to the input terminal of the first inverter, and the control terminal of the third transistor being configured to receive an inverted scan signal that is opposite in polarity to the scan signal;

a fourth transistor having a first terminal, a second terminal and a control terminal, the first terminal of the fourth transistor being coupled to the output terminal of the first inverter, the second terminal of the fourth transistor being coupled to the input terminal of the first inverter, and the control terminal of the fourth transistor being coupled to the scan line; and a second storage component having a first terminal and a second terminal, the first terminal of the second storage component being coupled to the input terminal of the first inverter, and the second terminal of the second storage component being configured to receive a second system voltage.

17. The electronic device of claim 16, wherein:

the comparator further comprises a NAND gate having a first input terminal, a second input terminal and an output terminal, the first input terminal of the NAND gate being configured to receive the inverted scan signal, the second input terminal of the NAND gate being configured to receive an inverted light emission control signal that is opposite in polarity to the light emission control signal; and the first inverter comprises:

a fifth transistor having a first terminal, a second terminal and a control terminal, the first terminal of the fifth transistor being configured to receive a first system voltage and the control terminal of the fifth transistor being coupled to the input terminal of the first inverter;

a sixth transistor having a first terminal, a second terminal and a control terminal, the first terminal of the sixth transistor being coupled to the second terminal of the fifth transistor, the second terminal of the sixth transistor being coupled to the output terminal of the first inverter, and the control terminal of the sixth transistor being coupled to the output terminal of the NAND gate; and a seventh transistor having a first terminal, a second terminal and a control terminal, the first terminal of the seventh transistor being coupled to the second terminal of the sixth transistor, the second terminal of the seventh transistor being configured to receive the second system voltage, and the control terminal of the seventh transistor being coupled to the control terminal of the fifth transistor.

18. The electronic device of claim 17, wherein the first transistor, the second transistor, the fourth transistor, the fifth transistor and the sixth transistor are P-type transistors, and the third transistor and the seventh transistor are N-type transistors.

19. The electronic device of claim 14, wherein the waveform reshaper comprises:

a second inverter having an input terminal and an output terminal, the input terminal of the second inverter being coupled to the output terminal of the comparator;

a third inverter having an input terminal and an output terminal, the input terminal of the third inverter being coupled to the output terminal of the second inverter; and a fourth inverter having an input terminal and an output terminal, the input terminal of the fourth inverter being coupled to the output terminal of the third inverter, and the output terminal of the fourth inverter being configured to output the emission duration modulation signal.

* * * * *